US012012268B2

(12) United States Patent
Uyeda

(10) Patent No.: US 12,012,268 B2
(45) Date of Patent: Jun. 18, 2024

(54) PACKAGING WITH INTEGRATED PAPER SPRING

(71) Applicant: Apple Inc., Cupertino, CA (US)

(72) Inventor: Mark T. Uyeda, Campbell, CA (US)

(73) Assignee: Apple Inc., Cupertino, CA (US)

( * ) Notice: Subject to any disclaimer, the term of this patent is extended or adjusted under 35 U.S.C. 154(b) by 299 days.

(21) Appl. No.: 17/219,355

(22) Filed: Mar. 31, 2021

(65) Prior Publication Data

US 2022/0315303 A1 Oct. 6, 2022

(51) Int. Cl.

*B65D 81/02* (2006.01)
*B65D 81/05* (2006.01)
*B65D 81/07* (2006.01)

(52) U.S. Cl.

CPC ..... *B65D 65/44* (2013.01); *B65D 81/022* (2013.01); *B65D 81/025* (2013.01); *B65D 81/057* (2013.01); *B65D 81/07* (2013.01)

(58) Field of Classification Search

CPC .... B65D 65/44; B65D 81/022; B65D 81/025; B65D 81/057; B65D 81/07; B65D 5/6697; B65D 5/5021; B65D 5/2009; B65D 5/22; B65D 5/0045; B65D 5/443; B65D 5/06

USPC ..... 229/168; 206/521, 592, 499, 448, 583, 206/765, 167, 191, 122.32, 103.11; 220/23.88; 493/405

See application file for complete search history.

(56) References Cited

U.S. PATENT DOCUMENTS

| | | | | | |
|---|---|---|---|---|---|
| 2,148,048 | A * | 2/1939 | Gray | B65D 5/2009 | 47/84 |
| 2,684,194 | A * | 7/1954 | Frankenstein | B65D 5/6626 | 229/176 |
| 4,360,145 | A * | 11/1982 | Wilcox | B65D 81/107 | 206/521 |
| 4,802,619 | A * | 2/1989 | Laido | B65D 5/443 | 229/125.32 |
| 10,994,889 | B1 * | 5/2021 | Rumsam | B65D 5/5028 | |
| 2022/0081153 | A1 * | 3/2022 | Fernandez | B65D 81/053 | |
| 2023/0079525 | A1 * | 3/2023 | Tuano | B65D 81/057 | 229/128 |

FOREIGN PATENT DOCUMENTS

EP 0313729 A2 * 5/1989

* cited by examiner

*Primary Examiner* — Christopher R Demeree
(74) *Attorney, Agent, or Firm* — Sterne, Kessler, Goldstein & Fox P.L.L.C.

(57) ABSTRACT

Packaging may include a base box having a cavity to receive a product, and a first paper spring extending from an interior of a first sidewall of the base box and a second paper spring extending from an opposing interior of a second sidewall of the base box. Each of the first and second paper springs may be formed from the same blank as the first sidewall. The first and second springs are flexible such that the cavity may accommodate products of different lengths, and may resiliently absorb vibrations or impact forces during shipping.

18 Claims, 6 Drawing Sheets

PACKAGING WITH INTEGRATED PAPER SPRING

FIELD

The described embodiments relate generally to packaging. More particularly, the present embodiments relate to packaging having integrated springs made from paper or other recyclable materials that may be otherwise cellulose-fiber based.

BACKGROUND

The described embodiments relate generally to packaging, including paper springs and packaging that uses them. More particularly, the present embodiments relate to packaging using integrated paper springs, such as corrugated cardboard springs. Product packaging is an integral part of a customer's experience. It introduces the customer to their product, and can affect the customer's feelings toward the product and the company that created it.

In some situations, such as direct-to-consumer shipping, a shipping packaging such as a shipper box may be used to ship a finished goods package containing a product. Certain current shipping packaging may use retention systems using a polymeric film to retain the finished goods package within the shipper. Other shipping packaging may use expanded polystyrene cushions, or other less environmentally friendly cushioning systems. And in each of these existing shipping packaging systems, different sized products will require a separately sized box or separately designed or sized cushion.

What is needed is a packaging paradigm that can maintain packaging integrity and cushioning characteristics prior to being received by an end user, but both increase recyclability of the packaging while improving the flexibility of the supply chain by allowing various products or finished goods packaging to be received in a shipping packaging.

SUMMARY

Some embodiments are directed to packaging having a base box with a cavity to receive a product, and a lid configured to close the base box and enclose the product within the packaging. The packaging includes a first paper spring extending from an interior of a first sidewall of the base box. The first paper spring is continuous with the first sidewall. The first paper spring may be formed from the same blank as the first sidewall. A second paper spring extends from an opposing interior of a second sidewall of the base box, and the second paper spring is continuous with the second sidewall (and may be formed from the same blank as the second sidewall, similar to the first spring). The space between the first and second paper springs is configured to retain the product via compressive force.

Further, in response to an impact force, the first (or second) paper spring compresses and resiliently absorbs and damps the force and slows the acceleration of the product. In some embodiments, the lid extends from a sidewall of the base box such that it may fold over and cover the cavity. When the packaging is in a closed configuration, the lid and base retain product surfaces generally normal to the product surfaces retained by the first and second spring. The product may be one of a type of finished goods package containing an electronic device.

Some embodiments are directed to packaging having a base box having a cavity to receive a product, a first paper spring extending from an interior of a first sidewall of the base box, and a second paper spring extending from an opposing interior of a second sidewall of the base box. In some embodiments, the first paper spring is formed from the same blank as the first sidewall, and the second paper spring is formed from the same blank as the first sidewall. The first and second springs are flexible such that the cavity may accommodate products of different lengths.

In some embodiments, the packaging includes a lid configured to close the base box. The base box and lid may be formed from separate blanks.

The packaging may include a third paper spring extending from an interior of a third sidewall of the base box. The third paper spring is formed from the same blank as the first sidewall. The packaging may include a fourth paper spring extending from an opposing interior of a fourth sidewall of the base box, and the fourth paper spring is formed from the same blank as the first sidewall. The third and fourth springs are flexible such that the cavity may accommodate products of different widths. The third and fourth paper springs are disposed within the length defined by the terminal ends of the first and second springs when a product is placed in the cavity in some embodiments.

In some embodiments, the distal edge of the first and second paper spring is not fixed to another surface such that it may freely translate within the cavity.

The packaging may include a lid panel extending from the base box. The lid panel may include tabs configured to be folded into a space between the first and second side wall and the first and second paper spring, respectively (e.g., the first fold of the paper springs). The lid panel includes a front panel foldable such that in a closed configuration the front panel covers a front panel of the base box in some embodiments.

In some embodiments, the base box, first paper spring, and second paper spring are all formed from the same cardboard blank. In some embodiments, cavity is configured to receive a plurality of products, and wherein the products are finished goods packages each containing an electronic device.

Some embodiments are directed to packaging having a base box having a cavity to receive a product, a first paper spring inside the cavity and extending from a sidewall of the base box, and a second paper spring inside the cavity and extending from an opposing sidewall of the base box. In some embodiments, the first and second springs are flexible such that the cavity may accommodate products of different lengths, and such that they resiliently absorb impact along a first direction.

In some embodiments, each of the paper springs includes a plurality of v-shaped folds terminating in an edge that is not fixed to the interior of the base box. The most-distal v-shape fold has an upwardly pointing apex such that the last panel of the paper spring points town towards a bottom surface of the base box, in some embodiments.

The packaging may include a third paper spring inside the cavity and extending from a sidewall adjacent to the first paper spring, and a fourth paper spring inside the cavity and extending from a sidewall adjacent to the second paper spring such that the third and fourth paper springs are in opposing directions. The third and fourth springs are flexible such that the cavity may accommodate products of different widths.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
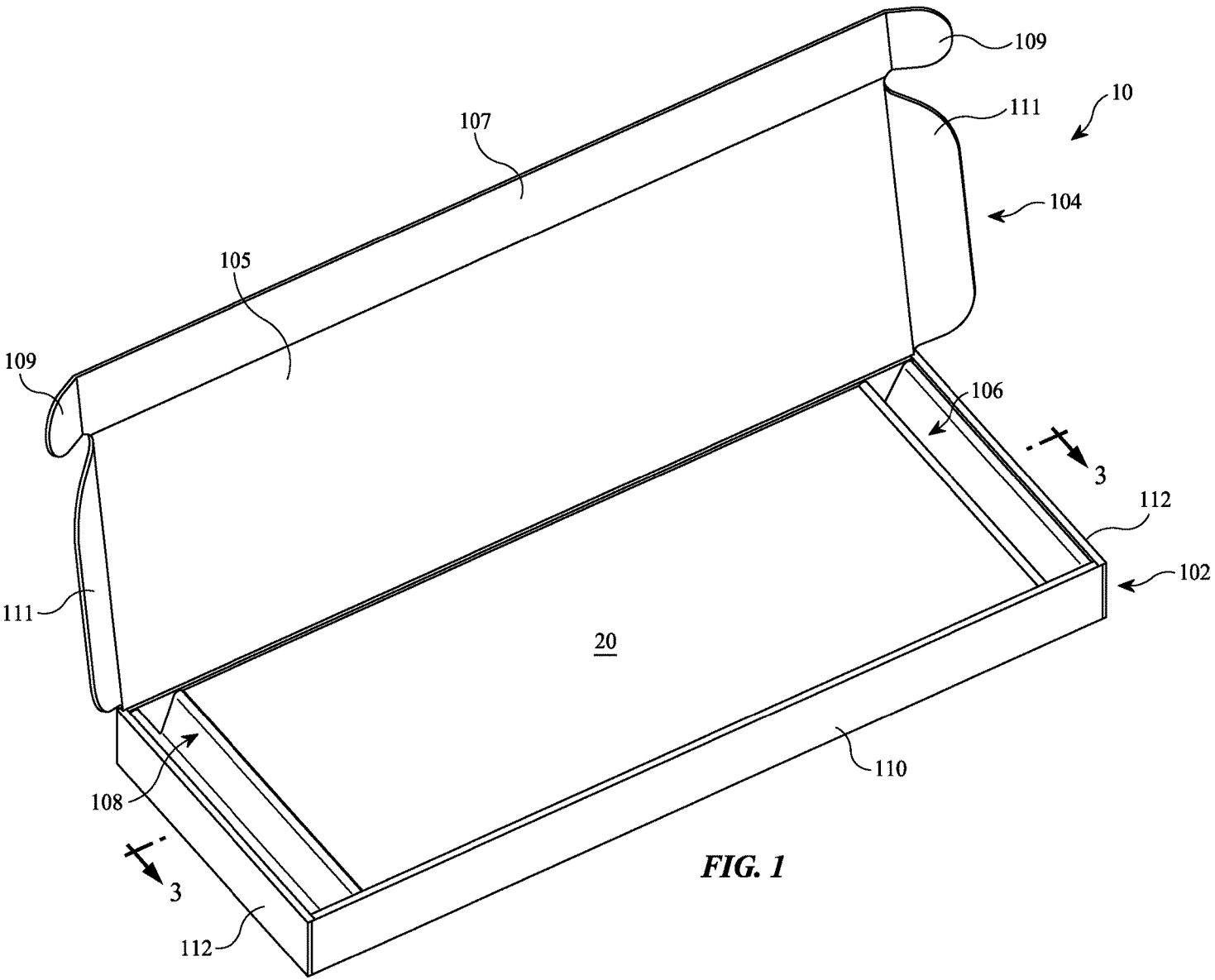
FIG. 1 shows a top perspective view of packaging with integrated paper springs and a product in an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The packaging described herein provides a packaging solution utilizing environmentally friendly materials and allows for a packaging solution that includes cushioning via cardboard springs integrated into shipping boxes. A base box and lid are disclosed that include an integrated paper spring, thereby easing recyclability. And indeed, recyclability is promoted also by the fact that the cardboard springs handle all of the impact and protection requirements such that the packaging as a whole does not include. Elements are described that achieve a structurally sound package, while allowing an end user to easily recycle the package, while providing sufficient cushioning and support during transport.

Some embodiments include packaging including a base box comprising cardboard, e.g., paperboard or cardboard corrugate (other environmentally friendly recyclable materials are also envisioned). In some embodiments, each of the base box or lid or both may be formed from a continuous sheet (e.g., a cardboard blank). The springs described herein also may be formed from other paper-based materials, or other environmentally friendly or recyclable materials. The respective elements may be formed of the same material or different materials that are recyclable in the same fiber-recycling stream. Advantageously, this improves upon prior systems having, for example, plastic film retention elements.

Companies may be sensitive to the cost of packaging and may wish to promote packaging that is eco-friendly. Certain packaging materials are higher cost due to their processing, and while engineers may be able to design single-component packaging, the cost may be prohibitive for certain materials, for example when separate packaging is required for different products, or different form factors of the same product.

Packaging made out of recyclable and/or biodegradable materials, such as paper can reduce environmental impact, especially when it replaces a plastic film component or an expanded polystyrene component, for example. Packaging that is interesting in character and well-executed may boost a product's or a brand's reputation, thereby attracting new customers and retaining previous customers. Packaging described in this document achieves these and other beneficial characteristics by balancing structural robustness, eco-friendly materials, and aesthetic elements. A product contained by the packaging may be, for example, an electronic device such as, for example, a desktop, monitor, laptop, tablet computer, or smartphone, smart watch, or it may be a non-electronic device.

In some embodiments, the packaging may be shipping packaging (e.g., packaging used for shipping a finished packaging for containing and conveying a product to a user such as may be used in a retail setting).

As described above, the packaging described herein provides a shipping packaging solution utilizing environmentally friendly materials, specifically cardboard (or other cellulose-based material). Cushioning properties via cardboard springs is provided, thereby increasing robust protection of a product being shipped, without materials that are not environmentally friendly. In general, the cardboard springs absorb impact energy through folds in the cardboard, thereby increasing the time of product deceleration during an impact. Beyond the energy absorption, the cardboard springs disclosed herein provide a retention effect that is flexible to accommodate a variety of sizes of a particular product or products.

Some embodiments include packaging including a paper spring comprising cardboard, e.g., cardboard corrugate. The paper spring (or entire packaging) may be formed from a single blank, folded to constrain the paper spring within the packaging. The paper springs described herein provide an alternative to, for example, foam type cushions used in packaging designs.

Advantageously, this improves upon prior systems having, for example, expanded polystyrene components, that are less environmentally friendly than cardboard components. By designing appropriate paper springs using cardboard impact resistance and elasticity can be achieved through cardboard components. Components described herein may provide a completely fiber based alternative to traditional expanded polystyrene, foam, or flexible retention film shipper designs used in previous packaging.

In utilizing eco-friendly materials such as cardboard structures, some prior designs may be more prone to permanent deformation during shipping. Packaging described herein improves on past designs, and provides eco-friendly components that may absorb multiple impacts due to their resilient design, and protect against potentially harmful vibrations during shipping—without adding additional components or complex substructures. Packaging described in this document achieves these and other beneficial characteristics by balancing structural robustness, eco-friendly materials, and aesthetic elements.

These and other embodiments are discussed below with reference to the accompanying figures. However, those skilled in the art will readily appreciate that the detailed description given herein with respect to these figures is for explanatory purposes only and should not be construed as limiting.

FIG. 1 shows a top perspective view of packaging 10 with first and second integrated paper springs 106/108. Packaging 10 includes a base box 102 with a cavity configured to receive product 20. Packaging 10 further includes a lid 104 to close product 20 within packaging 10. In some embodiments, lid 104 (e.g., lid panel 105) may extend directly from base box 102 (e.g., from a sidewall 110) and fold over to close packaging 10. In some embodiments, lid sidewall 107 may close over sidewall 110, and be of similar dimensions such that there is no overlap of lid sidewall 107 over the edge of sidewall 110. Lid sidewall 107 thus forms a front panel of the packaging 10. In some embodiments, a lid may be provided separately, or extending from a short side of the base box sidewall, rather a longer side as shown in FIG. 1.

In some embodiments, sidewalls 112 may form a portion of first paper spring 106 or second spring 108. In some embodiments, tabs 111 may close with lid panel 105 such that they are placed within a fold of an adjacent paper spring 106/108. Finally, front tabs 109 may be tucked in through an opening formed by the intersection of sidewall 112 and sidewall 110, such that the packaging 10 is fully closed.

Figure 2:
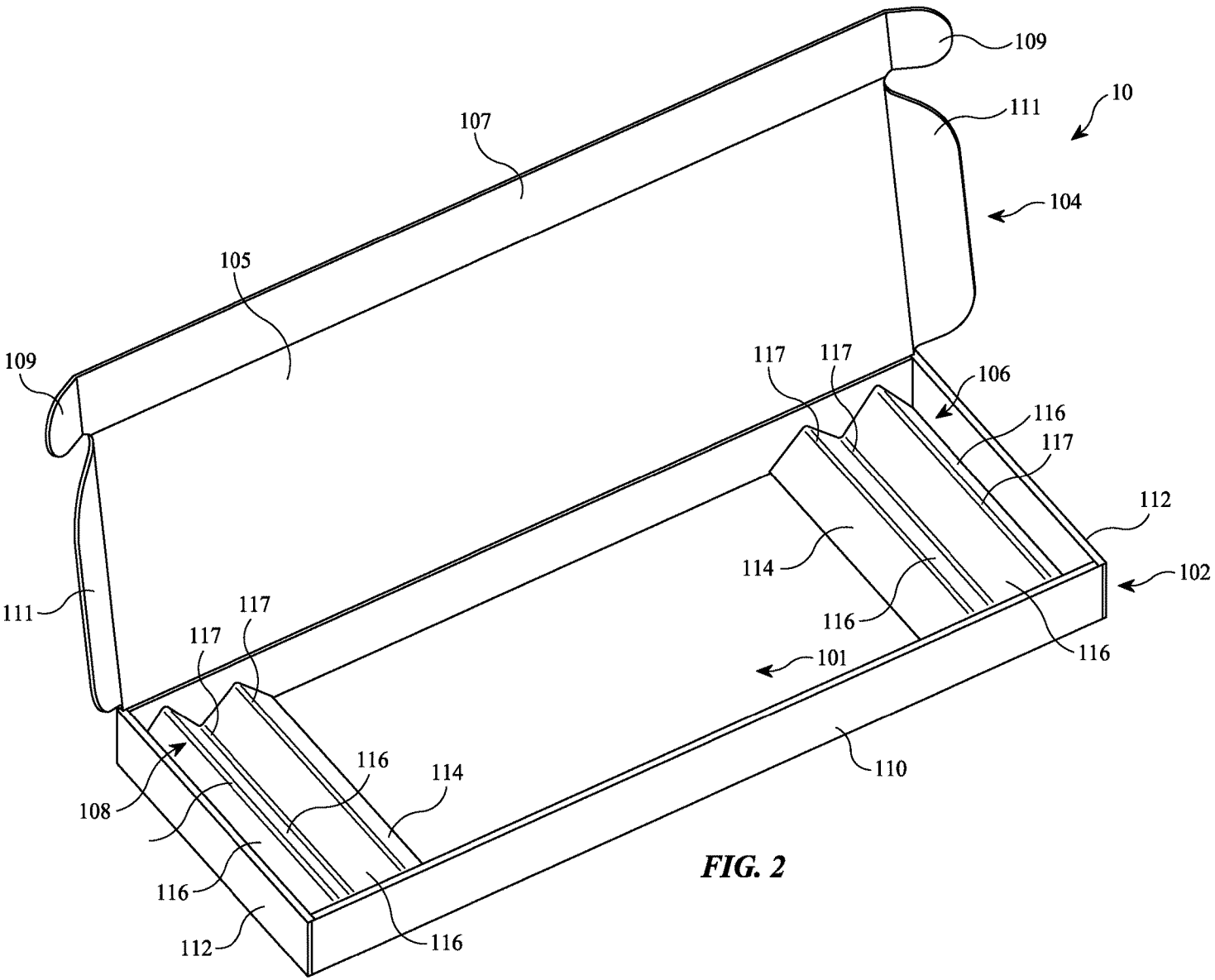
FIG. 2 shows the packaging with integrated paper springs shown in FIG. 1 with the product removed.

Comparing FIG. 1 and FIG. 2, it is shown in FIG. 2 that when product 20 is removed from packaging 10, paper springs 106/108 extend such that a larger distance is taken up in the cavity 101 of base box 102 by the springs. FIG. 2 shows that each of springs 106/108 may be made up as a zig-zag fold pattern having folds 117 and panels 116 alternating directions to produce a paper spring. As shown in FIG. 2, each of the springs includes a product support panel 114 that contacts product 20 when product 20 is placed within the cavity of base box 102.

Springs 106/108 may be integrally formed from a continuous substrate, for example, folded in a v-shape, or repeating v-shape in an accordion or zig-zag fashion. As shown in FIGS. 1 and 2, for example, in some embodiments, each of the paper springs may include a plurality of v-shaped folds terminating in an edge that is not fixed to the interior of the base box (i.e., a free end of the spring). The most-distal v-shape fold has an upwardly pointing apex such that the last panel of the paper spring points down towards a bottom surface of the base box, in some embodiments. In this regard, product 20 may be more easily placed within the cavity of base box 102, in that if product 20 contacts the product support panel 114, the spring simply translates to a more compressed state, rather than flattening the spring out and not retaining the product.

Figure 3:
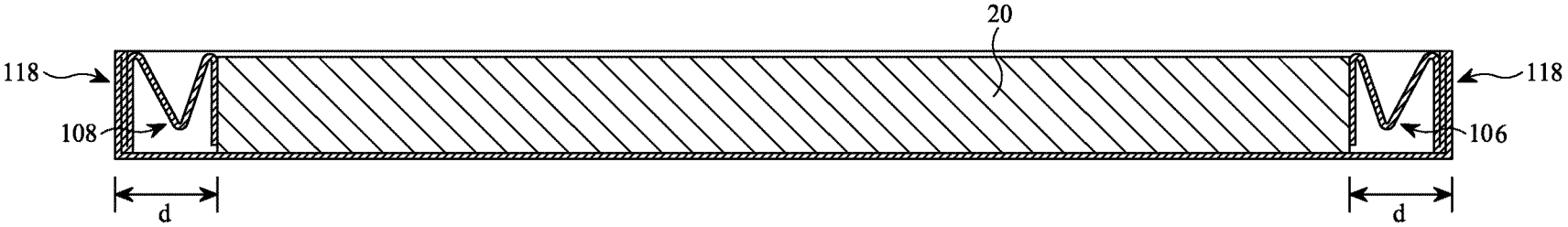
FIG. 3 shows a schematic side section view of the packaging with integrated paper springs with the lid closed and product in FIG. 1 in a first configuration.
Figure 4:
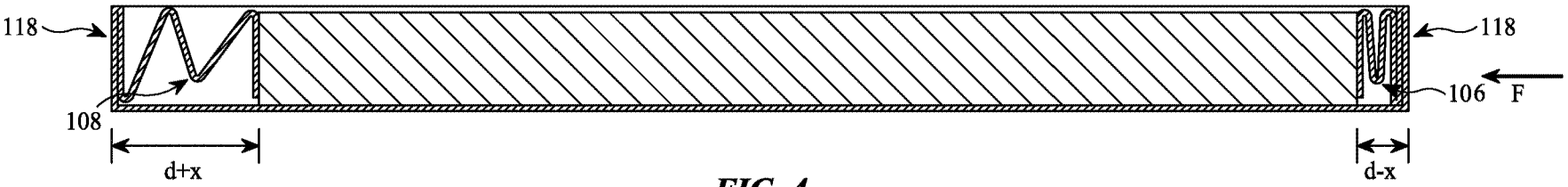
FIG. 4 shows a schematic side section view of the packaging with integrated paper springs with the lid closed and product in FIG. 1 in a second configuration.

Turning to FIGS. 3 and 4, a schematic section view of packaging 10 is shown having a first configuration shown in FIG. 3, and second configuration shown in FIG. 4, showing product 20 and paper springs 106 and 108 in their relative positions (the lid is omitted for clarity). The relative positions indicate the lateral displacement of product 20 when an impact force "F" is applied to a sidewall, whereby paper spring 106 is compressed and paper spring 108 is extended such that there is less compression (potentially to a free length of the spring). As shown, the distal ends of paper springs 106/108 are not connected to a bottom surface (i.e., bottom surface defining cavity 101) of base box 102, such that the product support panel 114 (as indicated in FIG. 2, for example) may translate within the cavity of base box 102.

In some embodiments, the distance "d" between product support panel 114 and the exterior of a sidewall may be equidistant in the first configuration (due, e.g., to paper springs 106/108 applying equal force to opposing sides of product 20), and the respective paper springs extend or compress, respectively, by a second distance "x" as shown in FIG. 4 (due, e.g., to external force "F" applied to one side). This configuration provides elasticity and protection during an impact event. The resilience imparted by the structure of the paper springs described herein provide for absorbing an impact without damage to the product or paper springs. The resilience is provided by deceleration of the product as each spring compresses. In some embodiments, spring characteristics are tuned (e.g., by material thickness, number of folds, direction of corrugation, etc.) such that hard-stack of the spring can be avoided for expected range of shipping and handling impacts, so minimize shock transmitted to product.

As shown in FIGS. 3-4, fold region 118 is configured such that the sidewall adjacent to the respective paper spring folds onto itself, and then back again such that it defines an end of the paper spring (i.e., a fixed end of the spring). In this way, paper springs 106/108 are integrally formed as an extension of sidewall 112 and require no adhesive but are nonetheless fixed in position relative to sidewall 112 as a natural extension. As appreciated from FIG. 2, tab 111 may be placed between an interior of the folded region 118 and the first panel 116 of the respective paper springs when packaging 10 is closed.

In the example shown in FIGS. 1-4, the lower inside panel of base box 102 and the lid panel 105 retain and secure product 20 within packaging 10. The insertion of product 20 into base box 102 and between the paper springs 106/108 compresses paper springs 106/108 into a loaded state (e.g., the second configuration) as shown in the comparison between FIGS. 1 and 2. And in some embodiments, product 20 may also be able to translate a safe distance along the compression axis of the paper springs 106/108, e.g., during a drop event or in response to vibrations encountered in shipping. In some embodiments, the paper springs may be disposed on one or more of the surfaces inside packaging 10. That is, in the example shown in FIGS. 1-4, only two paper springs are provided—in some embodiments one of the paper springs may be omitted, or others added. Additionally, in some embodiments, the paper springs may be disposed in different orientations, e.g., not just generally parallel with sidewalls 112.

In addition to potential cushioning or protection against vibration, the configurations of the paper springs described herein allow for more relaxed tolerances in dimensions of product 20 and packaging 10, because potential gaps or variations among the dimensions of different products 20 are accounted for with the application of the paper springs 106/108.

In some embodiments, depending on the features and nature of product 20, different sizes of the same product (or different products having different sizes) may be accommodated in packaging 10 due to the flexible nature of the paper springs 106/108. This advantageously provides flexibility in the supply chain, and simplifies packaging manufacturing in that where two or more shipping packages may have previously been required to ship the products, the described embodiments may eliminate the need for one or more different size or design of shipping packaging.

In some embodiments, the product (e.g., product 20) described may be a finished goods package, itself housing a product or products inside. In some embodiments, the packaging may house multiple products, and the paper springs described herein may support a plurality of products.

Figure 5:
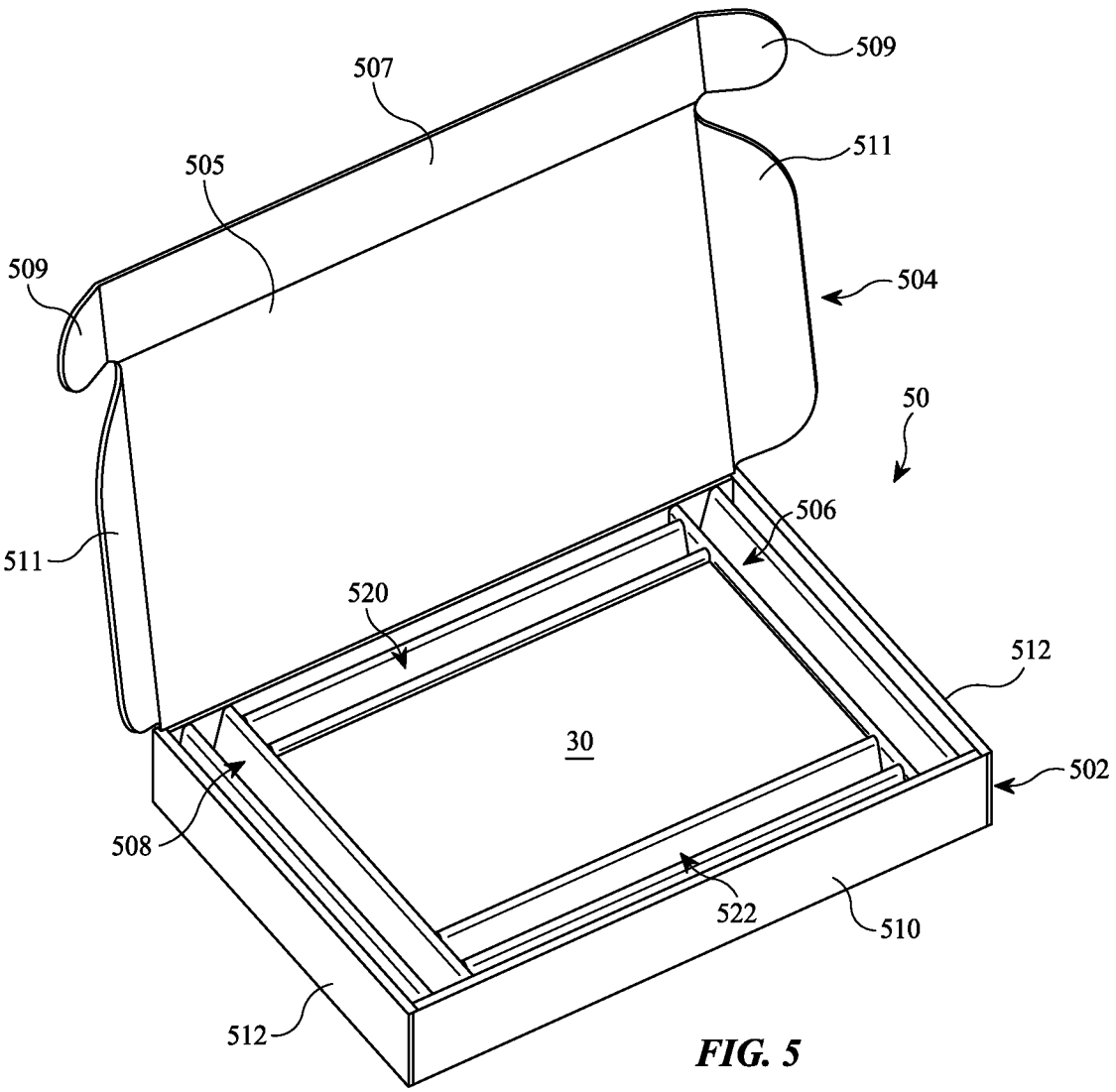
FIG. 5 shows a top perspective view of packaging with integrated paper springs and a product in an embodiment.
Figure 6:
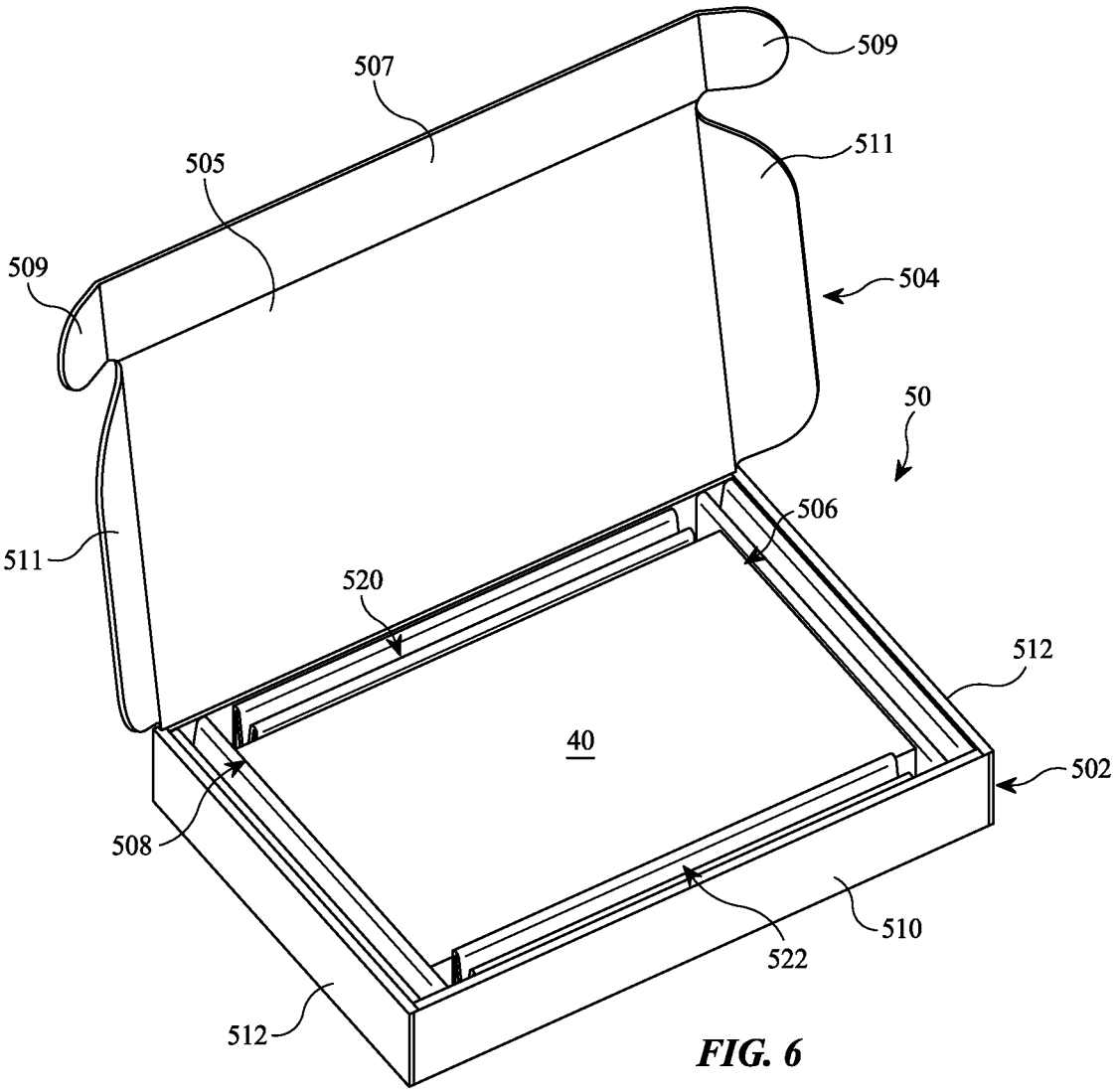
FIG. 6 shows a top perspective view of the packaging with integrated paper springs shown in FIG. 5 and a different product in an embodiment.

FIG. 5 shows a top perspective view of packaging 50 with integrated paper springs and a product 30 in an embodiment, and FIG. 6 shows a top perspective view of the packaging 50 with integrated paper springs shown in FIG. 5 and a different product 40 in an embodiment. As shown, product 40 has different dimensions than product 30 and is larger, but is accommodated sufficiently within packaging 50 without modification to the packaging or paper springs.

Packaging 50 has first and second integrated paper springs 506/508, similar to paper springs 106/108. Additionally, as shown in FIGS. 5 and 6, packaging 50 further includes third paper spring 520 and fourth paper spring 522. In this regard, spring force and retention is provided on opposing sides of product 30 or 40, respectively. Indeed, packaging 50 allows for two different sets of opposing sides to allow translation of a product within the packaging. This allows for protection from at least two generally perpendicular directions, as shown in the figure. In this way, in some embodiments, force from an impact event or vibration may be accommodated in two directions (in contrast to the configuration shown in FIG. 1).

And packaging 50 includes a base box 502 with a cavity configured to receive product 30 or 40. Packaging 50 further includes a lid 504 to close product 30 or 40 within packaging 50. In some embodiments, lid 504 (e.g., lid panel 505) may extend directly from base box 502 (e.g., from a sidewall 510) and fold over to close packaging 50. In some embodiments, lid sidewall 507 may close over sidewall 510, and be of similar dimensions such that there is no overlap of lid sidewall 507 over the edge of sidewall 510.

In some embodiments, sidewalls 512 may form a portion of first paper spring 506 or second spring 508. In some embodiments, sidewalls 510 may form a portion of springs 520/522. In some embodiments, tabs 511 may close with lid panel 505 such that they are placed within a fold of an adjacent paper spring 506/508. Finally, front tabs 509 may be tucked in through an opening formed by the intersection of sidewall 512 and sidewall 510, such that the packaging 50 is fully closed. In some embodiments, paper springs 520/522 may be inset from paper springs 506/508 as shown, or vice versa. That is the third and fourth paper springs 520/522 are disposed within the length defined by the terminal ends of the first and second springs 506/508, when a product is placed in the cavity in some embodiments.

As with the embodiments described above, in packaging 50, the sidewall adjacent to the respective paper spring folds onto itself, and then back again such that it defines an end of the paper spring. In this way, each of the paper springs are integrally formed as an extension of the sidewall. Different from packaging 10, where lid 104 is integrally formed from the same blank as base box 102, lid 504 is formed from a separate blank as described below.

As discussed herein, components of the packaging described may be formed from one or more blanks, e.g., cardboard or paper blanks. In some embodiments, the blank is formed of a single continuous substrate, such as, for example cellulose-based material like cardboard corrugate. Other cellulose-based materials are contemplated, such as paperboard, certain molded fiber components of sufficient construction, or grayboard. Tabs, flaps, and regions without adhesive of the blank are folded such that no adhesive is visible in finished packaging. In some embodiments, adhesive may be omitted and the various flaps and tabs attached in another suitable manner (e.g., by mechanical interlock or press fit).

Figure 7:
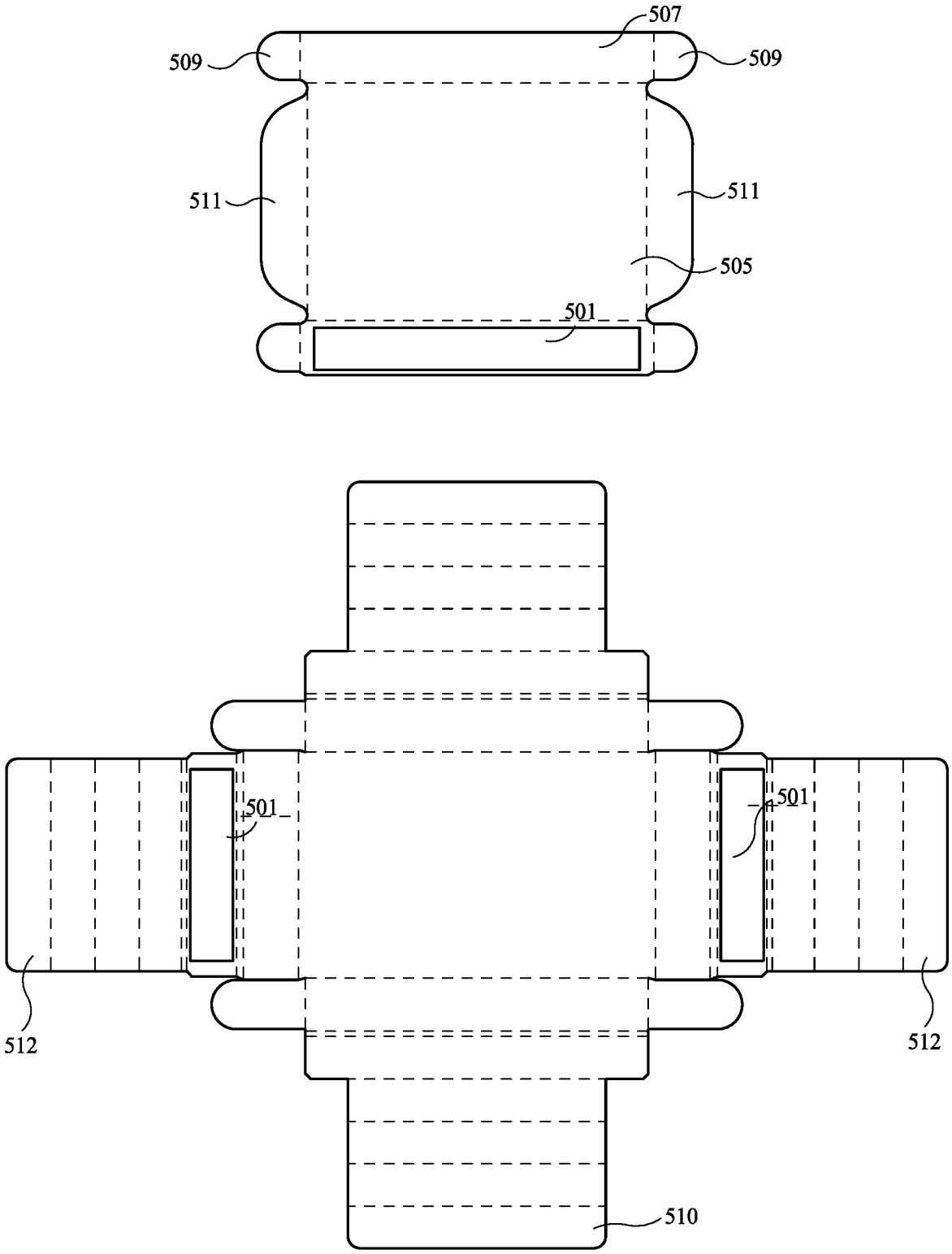
FIG. 7 shows a view of blanks used to produce the packaging with integrated paper springs of FIG. 5.

Turning to FIG. 7, a view of blanks used to produce the packaging with integrated paper springs of FIG. 5 is shown (and a similar blank would be used with regard to FIG. 1, though without the second set of spring panels). The blank at the upper region shows the blank that lid 504 is formed from. In some embodiments, lid 504 is fixed to base box 102 via an adhesive region 501 shown as a solid rectangle on the lid blank. FIG. 7 shows the fold lines as dashed lines, such that the panels and tabs are folded to make packaging 50 take its assembled configuration, ready to receive a product. In some embodiments, the fold lines may be at an angle relative to the blanks corrugation, e.g., at 45 degrees for a 4-spring version such as that in FIG. 7. In this way, similar spring characteristics are provided to all four springs, and each direction is affected uniformly by the corrugation direction (i.e., it is not the case that one set of springs is folded parallel to the corrugations and the other set of springs is folded perpendicular to the corrugations).

Each of the components may be composed of recyclable materials including the shipping packaging, finished packaging, seals, and other related components. Thus, if and when the customer opts to dispose of the packaging, the packaging may simply be recycled without requiring material separation (e.g., in a single-stream recycling program). Advantageously, this improves upon prior systems having, for example, retention film shipping systems or polystyrene cushioning.

Each of the components and their constituent parts, and other variations described herein may include corresponding features described with reference to each of the other components and features described without limitation.

In some embodiments, any surface finishing may take place after the components are cut from the blank, or alternatively prior to the blank being cut into separate sheets for assembling to a final product. Additionally, some operations may be performed concurrently. All or some of the surfaces of the packaging may be coated, or laminated, which may increase structural strength properties such as rigidity and which may protect a product within the packaging, or avoid scratching.

Additionally, the packaging may be manufactured in a cost-effective and environmentally-friendly way. In some embodiments, the packaging components may be constructed of a single integrally-formed piece of material. The single integrally-formed piece of material may be a foldable material that is folded into a configuration that holds and secures a product, either alone or within a cavity of a packaging container. In some embodiments, the foldable material may be a single piece of material that is cut by a single operation (e.g., a single die-cutting operation). In some embodiments, the foldable material may be die cut from a stock material (e.g., a sheet of cardboard corrugate, or roll of material), or other fiber or cellulose based material. Single integrally-formed pieces of material that are cut by a single cutting operation may facilitate efficient and reproducible manufacturing. Moreover, such manufacturing may reduce waste by reducing waste material during manufacturing.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. Packaging, comprising:

a base box having a cavity to receive a product;

a lid configured to close the base box and enclose the product within the packaging;

a first paper spring extending from an interior of a first sidewall of the base box, the first paper spring being continuous with the first sidewall and comprising a plurality of v-shaped folds terminating in a free end not fixed to the base box within the cavity: and a second paper spring extending from an interior of a second sidewall of the base box, wherein the interior of the second sidewall faces the interior of the first sidewall, wherein the second paper spring is continuous with the second sidewall, and wherein the first and second paper springs are configured to absorb or damp movement of the product within the cavity via compressive force.

2. The packaging of claim 1, wherein in response to an impact force, the first paper spring compresses and resiliently absorbs the force and slows the acceleration of the product.

3. The packaging of claim 1, wherein the lid extends from a sidewall of the base box such that it may fold over and cover the cavity.

4. The packaging of claim 1, wherein when the packaging is in a closed configuration, the lid and base retain product surfaces in a direction generally normal to the first and second spring.

5. The packaging of claim 1, wherein the lid and the base box are formed from the same blank.

6. The packaging of claim 1, wherein the base box, first paper spring, and second paper spring are all formed from the same cardboard blank.

7. A packaged product, comprising: the packaging of claim 1; and the product, wherein the product is a finished goods package containing an electronic device.

8. Packaging, comprising:

a base box having a cavity to receive a product;

a first paper spring extending from an interior of a first sidewall of the base box, wherein the first paper spring is formed from the same blank as the first sidewall;

a second paper spring extending from an opposing interior of a second sidewall of the base box, wherein the second paper spring is formed from the same blank as the first sidewall, and wherein the first and second springs are flexible such that the cavity may accommodate products of different lengths, wherein distal edges of the first and second paper springs are not fixed to another surface, such that they may freely translate within the cavity;

a third paper spring extending from an interior of a third sidewall of the base box, wherein the third paper spring is formed from the same blank as the first sidewall; and a fourth paper spring extending from an opposing interior of a fourth sidewall of the base box, wherein the fourth paper spring is formed from the same blank as the first sidewall, and wherein the third and fourth springs are flexible such that the cavity may accommodate products of different widths.

9. The packaging of claim 8, further comprising a lid configured to close the base box, wherein the base box and lid are formed from separate blanks.

10. The packaging of claim 8, wherein the third and fourth paper springs are disposed between terminal ends of the first and second springs when a product is placed in the cavity.

11. The packaging of claim 8, further comprising a lid panel extending from the base box, wherein the lid panel includes tabs, each tab configured to be folded into a space between the first sidewall and the first fold of the first paper spring or a space between the second sidewall and the first fold of the second paper spring.

12. The packaging of claim 11, wherein the lid panel includes a front panel foldable such that in a closed configuration the front panel covers a front panel of the base box.

13. A packaged product, comprising: the packaging of claim 8; and the product, wherein the product is a finished goods package containing an electronic device.

14. The packaging of claim 8, wherein the cavity is configured to receive a plurality of products, and wherein the products are finished goods packages each containing an electronic device.

15. Packaging, comprising:

a base box having a cavity to receive a product;

a first paper spring inside the cavity and extending from a sidewall of the base box, the first paper spring formed from a plurality of panels and folds configured in a zig-zag fold pattern including a plurality of v-shaped folds terminating in an edge that is not fixed to the interior of the base box; and a second paper spring inside the cavity and extending from an opposing sidewall of the base box, the second paper spring formed from a plurality of panels and folds configured in a zig-zag fold pattern including a plurality of v-shaped folds terminating in an edge that is not fixed to the interior of the base box, wherein the first and second springs are flexible such that the cavity may accommodate products of different lengths, and such that they resiliently absorb impact along a first direction.

16. The packaging of claim 15, wherein the most-distal v-shape fold has an upwardly pointing apex such that the last panel of the paper spring points down towards a bottom surface of the base box.

17. The packaging of claim 15, further comprising:

a third paper spring inside the cavity and extending from a sidewall adjacent to the first paper spring; and a fourth paper spring inside the cavity and extending from a sidewall adjacent to the second paper spring such that the third and fourth paper springs are in opposing directions, wherein the third and fourth springs are flexible such that the cavity may accommodate products of different widths.

18. A packaged product, comprising: the packaging of claim 15; and the product, wherein the product is a finished goods package containing an electronic device.

* * * * *